US005496205A

United States Patent [19]

Lee

[11] Patent Number: 5,496,205

[45] Date of Patent: Mar. 5, 1996

[54] BRASSIERE WITH CONCEALED CLOSABLE POCKETS

[76] Inventor: Lausanne Lee, P.O. Box 373, Denver, Colo. 80201

[21] Appl. No.: 358,488

[22] Filed: Nov. 22, 1994

[51] Int. Cl.[6] ..... A41C 3/00; A41D 27/20

[52] U.S. Cl. ..... 450/89; 450/57; 2/247; 2/250

[58] Field of Search ..... 2/73, 247, 248, 2/249, 250, 251, 252; 450/30, 31, 32, 36, 89, 54, 55, 56, 57, 58

[56] References Cited

U.S. PATENT DOCUMENTS

| | | | |
|---|---|---|---|
| 1,136,727 | 4/1915 | Smith | 450/36 |
| 1,273,419 | 7/1918 | Stewart | 2/249 |
| 2,610,325 | 9/1952 | Schuessel | 450/89 |
| 2,920,628 | 1/1960 | Vork | 450/89 |
| 3,384,091 | 5/1968 | Block | 450/89 X |
| 4,217,905 | 8/1980 | Atwater et al. | 450/74 |
| 4,699,144 | 10/1987 | Sherwood | 450/54 |
| 5,395,280 | 3/1995 | Greenberg | 450/54 |

*Primary Examiner*—Jeanette E. Chapman

[57] ABSTRACT

A brassiere having concealed pockets which are configured and sized for adaptability to breast variations and cup configurations. The concealed closable pockets are configured and sized to dwell within the upper section of each brassiere cup, having upper and lower sheet portions folded over and stitched together. The pocket opening is designed with an inner lip portion, which is reinforced and includes fasteners, such as VELCRO™ fastener strips to secure enclosed valuables in the pocket.

2 Claims, 3 Drawing Sheets

BRASSIERE WITH CONCEALED CLOSABLE POCKETS

BACKGROUND OF THE INVENTION

This invention relates to a brassiere with concealed closable pockets, and more specifically to a brassiere which incorporates pockets within the lining of the cups to provide for convenience and safety of valuables.

PRIOR ART

Brassieres have been developed and mass produced for decades to provide increased support and elevation of breast for a more appealing body form and figure. Over the years brassieres have been designed in many styles, from underwire to full support, from seamless to strapless, and from full body to self-supporting cups.

The present invention improves on the heretofore known brassieres by incorporating concealed closable pockets for valuables, constructed within the internal structure of the brassiere. The construction of the pockets, placed in the inside upper section of each cup, provides for a comfortable fit with the additional enhancement of safety for valuables.

SUMMARY OF THE INVENTION

The brassiere of the present invention is constructed having a pair of concealed closable pockets, one in each cup. Each brassiere cup has a front-outer fabric lining, an intermediate padded lining, a concealed closable pocket, and a rear-outer fabric lining.

The concealed closable pockets are located in the upper section of each brassiere cup. The pockets are concealed between the intermediate padded lining and the rear-outer fabric lining, which allows valuables to be concealed within the pockets and invisibility of valuables from the exterior view of the brassiere. The opening of the pockets are reinforced with fasteners, such as VELCRO™ fastener strips.

The brassiere cups and pockets are configured and sized to meet various breast specifications, enhancing comfort and fit.

OBJECTS AND ADVANTAGES

Besides the objects and advantages of the closable pockets described in my above patent, several objects and advantages of the present invention are:

(a) to provide a comfortable fitting brassiere in a wide variety of colors and styles, but all providing the convenience of the concealed closable pockets for safety of valuables;

(b) to provide a brassiere with concealed closable pockets which is configured and sized to accommodate the various sizes of wearers;

(c) to provide a brassiere which incorporates concealed pockets in each cup, which is invisible from the exterior view of the brassiere;

(d) to provide a brassiere with concealed closable pockets which does not interfere with the basic look, fit and comfort of the brassiere;

(e) to provide a brassiere with concealed closable pockets made with superior quality;

(f) to provide a closable pocket in each brassiere cup which is concealed on the inside upper linings of the brassiere, allowing for convenient access to pocket opening;

(g) to provide pockets constructed within each brassiere cup, sewn into an alternative seam, which allows for secure fitting within the lining of the brassiere;

(h) to provide a pocket which is reinforced with fasteners, such as VELCRO™ fastener strips to secure valuables inside the pocket; and (i) to provide a brassiere option to the wearer, which provides additional convenience and enhanced safety of valuables during a variety of activities.

Additional objects and advantages are to provide a brassiere with concealed closable pockets which can be easily and conveniently opened and resealed without being too obvious and which provides ample space and comfort to conceal small valuables. Further objects and advantages will become apparent from a consideration of the ensuing description and drawings.

BRIEF DESCRIPTION OF THE DRAWINGS

The formal drawings provide related figures which explain in detail the construction, placement and implementation of the concealed pockets located within the structure of the cups.

Figure 1:
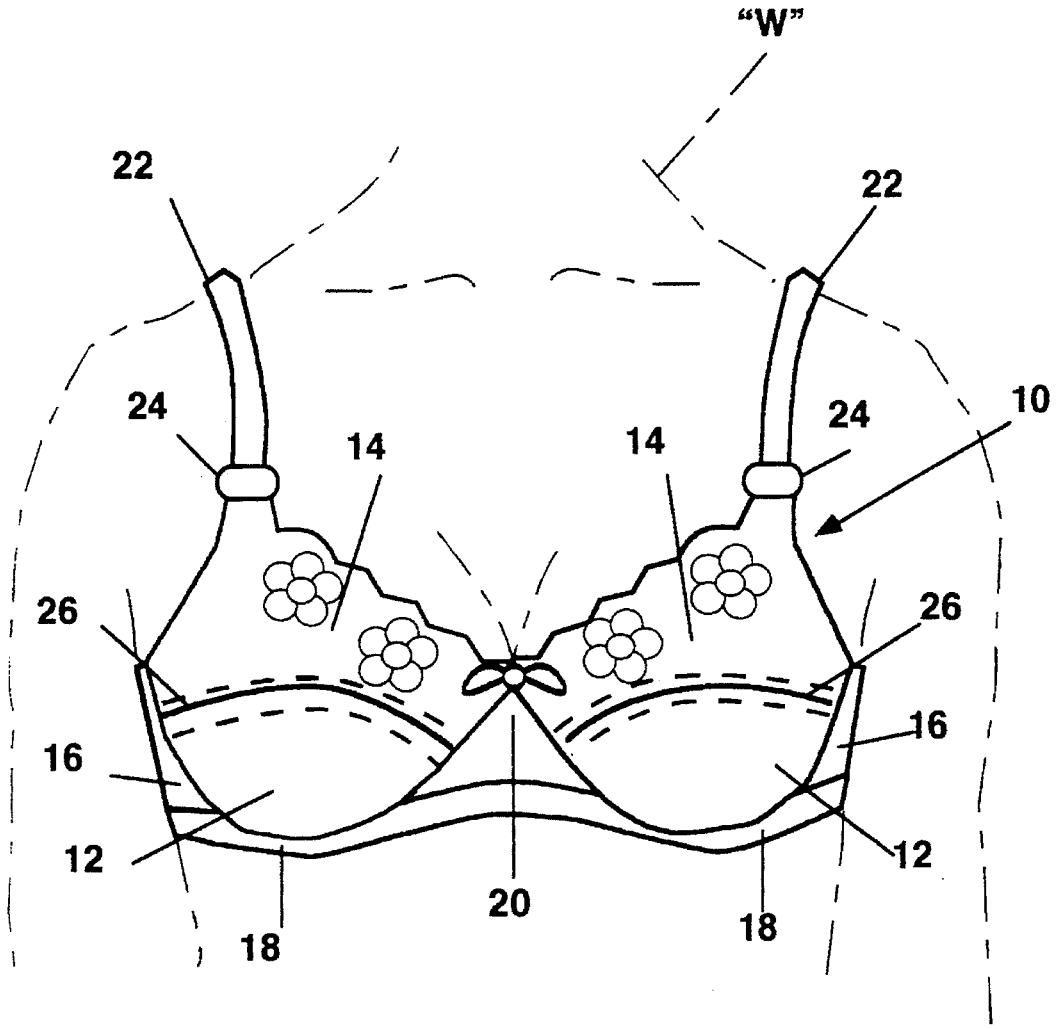
FIG. 1 is a perspective view, representing the frontal appearance of the invention as it is worn on the body.

| List of Reference Numerals |
|---|
| 10 brassiere |
| 12 breast cups |
| 14 front-outer lining |
| 16 side/back panels |
| 18 elastic band |
| 20 alternative center section |
| 22 shoulder straps |
| 24 alternative rings |
| 26 alternative reinforced seam |
| 28 concealed closable pocket |
| 30 rear-outer lining |
| 32 opening to pocket |
| 34 fastener |
| 36 pocket inside |
| 38 intermediate padded lining |

DESCRIPTION OF INVENTION

Figure 2:
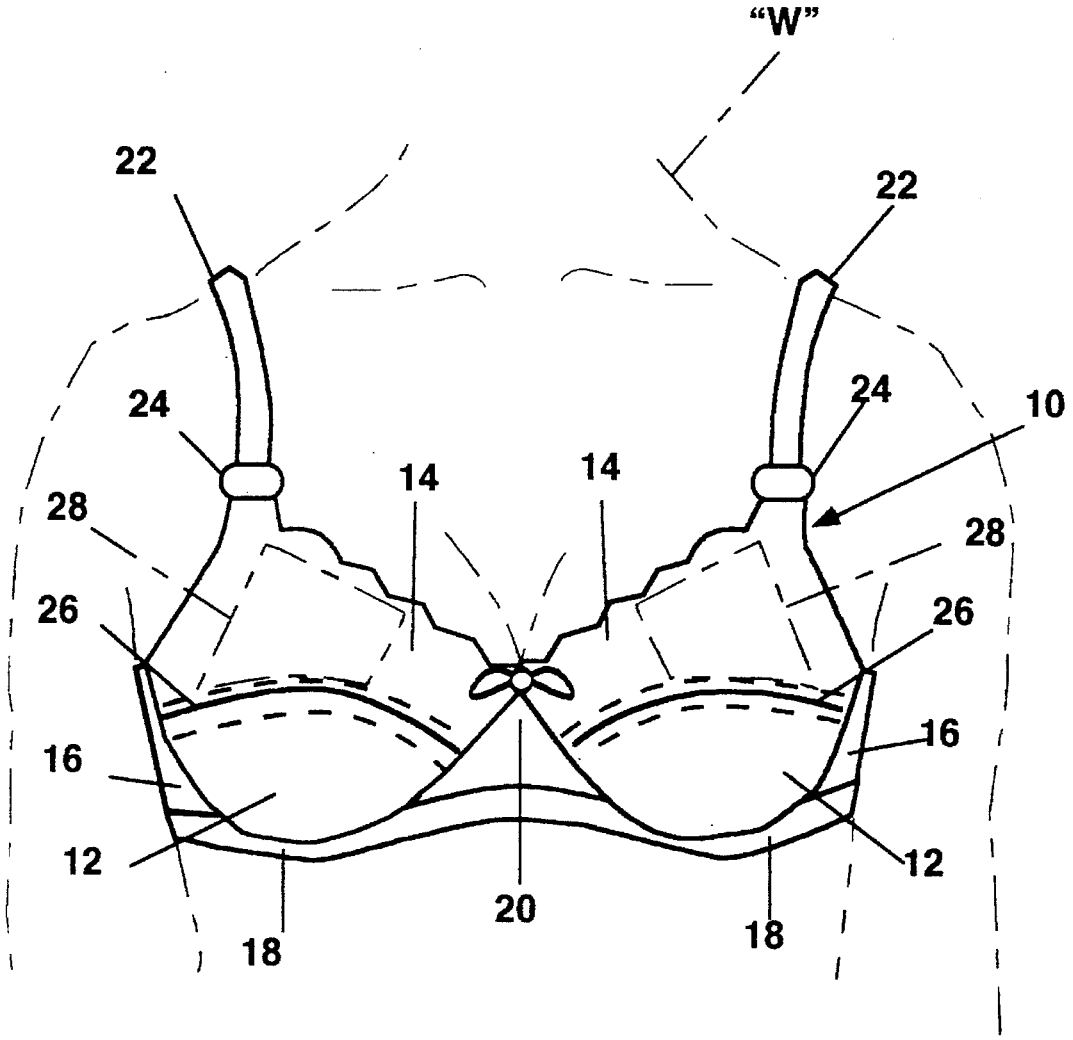
FIG. 2 is a view similar to FIG. 1 showing the location of the concealed closable pockets.
Figure 3:
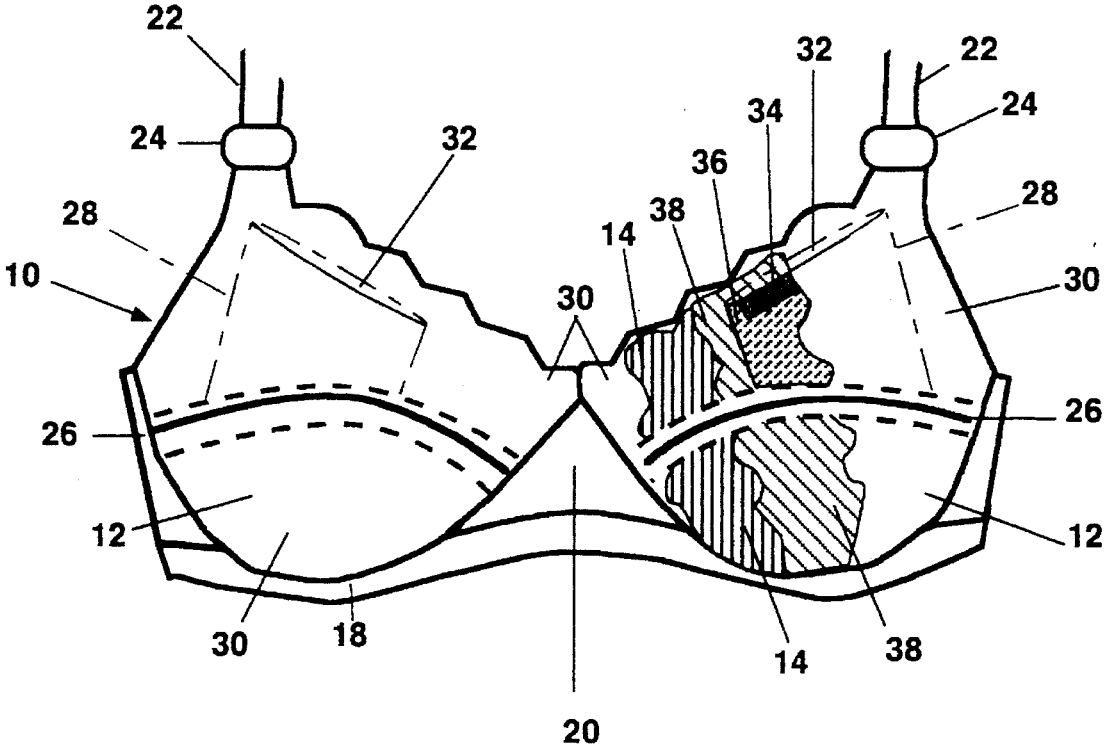
FIG. 3 shows the location and attributes of the concealed closable pocket as seen from the rear of the brassiere, the construction of the brassiere cup from the rear view, i.e., the rear-outer fabric lining, the intermediate padded lining, and the front-outer fabric lining.

Referring to the drawings, specifically FIG. 1–3, numeral 10 represents a brassiere with concealed closable pockets constructed in accordance with the present invention. Brassiere 10 includes a pair of individual brassiere breast cups 12 joined by an alternative center section 20. A pair of combined side/back panels 16 and elastic band 18 are joined, respectively, to the brassiere breast cups 12. The breast cups 12 and the side/back panels 16 are joined by an alternative connecting ring 24 to form shoulder straps 22. The side/back panels 16, the shoulder strap 22, and elastic band 18 are preferably made of elastic material. Also, interengaging fastening elements (not shown) are provided on the body of wearer.

The positioning of the concealed closable pockets 28 are revealed through the front-outer lining 14 in FIG. 2. Alternative reinforced seams 26 are constructed in each brassiere breast cup 12 to secure lower edge of the concealed closable pocket 28 within brassiere 10.

The construction of the concealed closable pockets 28 as implemented within the upper section of the brassiere breast cup 12 is shown in FIG. 3 and is a representation of the construction of both brassiere breast cups 12. FIG. 3 depicts a perspective/dissected view of the construction of the brassiere from the rear. The rear-outer lining 30, the concealed closable pocket 28, the intermediate padded lining 38 and the front-outer lining 14 are four separate members that are attached at the upper edges and sewn together.

The pockets are concealed between the intermediate padded lining and the rear-outer fabric lining. The front outer lining, the intermediate padded lining and the rear outer lining are sewn together to form an upper and a lower formation of the cup. In summary, each cup includes a pair of inside pockets. The inside pockets are positioned and attached to an upper seam of said intermediate padding lining and of said rear-outer lining adjacent said upper edge. The pockets include confronting edges adjacent said upper edges and fastening means for securing the confronting edges together. The pocket is constructed of flexible material attached to said intermediate padded lining and the rear-outer lining for concealed visibility from the front view of the brassiere.

Alternatively, the central region of the cup attaches the upper section to the lower section of the brassiere, supported by an alternative reinforced seam 26, which secures the lower edge of the concealed closable pocket to the brassiere.

The space between the inner linings of the pocket 36 defines a concealed closable pocket opening 32. An interengaging fastener such as VELCRO™ fastener strips 34 is attached to inner facing sections of the pocket opening 32 to secure valuables within the pocket.

I claim:

1. A combination brassiere with concealed closable pocket openings in each cup section for carrying small valuables, which are normally carried in a handbag or purse comprising:

a brassiere formed of a front-outer lining, an intermediate padded lining, a rear-outer lining, and pocket deposed between said intermediate padded lining and the rear-outer lining;

said front-outer lining, intermediate padded lining and rear-outer lining are sewn together to form an upper and lower formation of said cup;

each of said linings include an upper edge in said upper formation of said cup;

each cup includes a pair of inside pockets; said inside pockets are positioned and attached to an upper seam of said intermediate padding lining and of said rear-outer lining adjacent said upper edge;

the said pockets include confronting edges adjacent said upper edges; and fastening means for securing the confronting edges together; and the pocket is constructed of flexible material attached to said intermediate padded lining and the rear-outer lining for concealed visibility from the front view of the brassiere.

2. A combination brassiere with concealable closable pockets as defined in claim 1:

said cups are sized and configured to fit the cup measurements of a variety of wearers.

* * * * *